US010857820B2

(12) United States Patent
Arakane

(10) Patent No.: US 10,857,820 B2
(45) Date of Patent: Dec. 8, 2020

(54) PRINTING DEVICE AND CONTROL METHOD

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/506,668

(22) Filed: Jul. 9, 2019

(65) Prior Publication Data

US 2020/0016910 A1 Jan. 16, 2020

(30) Foreign Application Priority Data

Jul. 11, 2018 (JP) ..... 2018-131690

(51) Int. Cl.

| | |
|---|---|
| ***B41J 19/20*** | (2006.01) |
| ***B41J 25/00*** | (2006.01) |
| ***B41J 19/14*** | (2006.01) |
| ***B41J 2/21*** | (2006.01) |

(52) U.S. Cl.

CPC ..... *B41J 25/006* (2013.01); *B41J 2/2132* (2013.01); *B41J 19/145* (2013.01); *B41J 19/202* (2013.01)

(58) Field of Classification Search

CPC ..... B41J 25/006; B41J 19/145; B41J 19/202; B41J 2/2132

See application file for complete search history.

(56) References Cited

U.S. PATENT DOCUMENTS

| | | | | |
|---|---|---|---|---|
| 7,219,972 | B2 | 5/2007 | Kanematsu et al. | |
| 9,498,990 | B2 | 11/2016 | Fukuda | |
| 2005/0195230 | A1 | 9/2005 | Kanematsu et al. | |
| 2010/0066773 | A1* | 3/2010 | Taga | B41J 2/1752 347/6 |
| 2015/0145912 | A1* | 5/2015 | Fukuda | B41J 19/202 347/10 |
| 2017/0300276 | A1* | 10/2017 | Arakane | G06F 3/1275 |

FOREIGN PATENT DOCUMENTS

| | | | |
|---|---|---|---|
| JP | 2005-014533 | A | 1/2005 |
| JP | 2005-246641 | A | 9/2005 |
| JP | 2015-101071 | A | 6/2015 |

* cited by examiner

*Primary Examiner* — Yaovi M Ameh

(74) *Attorney, Agent, or Firm* — Banner & Witcoff, Ltd.

(57) ABSTRACT

A printing device includes: a controller configured to perform printing wherein in a first case where a first condition is not satisfied, the controller controls the main-scanning unit to perform the main-scanning at a first speed and controls the print head to discharge the ink to correspond to a specific pixel of a partial image to be printed by the partial printing when the print head is at a first position, and in a second case where the first condition is satisfied, the controller controls the main-scanning unit to perform the main-scanning at a second speed slower than the first speed and controls the print head to discharge the ink to correspond to the specific pixel when the print head is at a second position, which is located at a downstream of the first position in the direction of the main-scanning.

11 Claims, 14 Drawing Sheets

FIRST EXEMPLARY EMBODIMENT

FIG. 7A

THRESHOLD VALUE TABLE TT

| | | HEAD TEMPERATURE | | |
|---|---|---|---|---|
| | | LOW | MEDIUM | HIGH |
| CUMULATIVE INK USE AMOUNT | SMALL | 70% | 85% | 100% |
| | MEDIUM | 65% | 80% | 100% |
| | LARGE | 60% | 75% | 100% |

FIG. 7B

CONTROL SELECTION TABLE ST

CUMULATIVE INK USE AMOUNT: SMALL
HEAD TEMPERATURE: LOW

ST1

| DOT FORMATION RATE | EXECUTION CONTROL |
|---|---|
| 70%～80% | SPECIAL CONTROL A |
| 80%～90% | SPECIAL CONTROL B |
| 90%～95% | SPECIAL CONTROL C |
| 95%～ | SPECIAL CONTROL D |

CUMULATIVE INK USE AMOUNT: LARGE
HEAD TEMPERATURE: LOW

ST2

| DOT FORMATION RATE | EXECUTION CONTROL |
|---|---|
| 60%～75% | SPECIAL CONTROL A |
| 75%～85% | SPECIAL CONTROL B |
| 85%～92% | SPECIAL CONTROL C |
| 92%～ | SPECIAL CONTROL D |

...

FIG. 7C

CONTROL CONDITION TABLE CT

| CONTROL | MAIN-SCANNING SPEED | SHIFT AMOUNT | WEIGHT | DIVISION |
|---|---|---|---|---|
| NORMAL CONTROL | HIGH | 0 | ABSENCE | ABSENCE |
| SPECIAL CONTROL A | MEDIUM | SMALL (SHs) | ABSENCE | ABSENCE |
| SPECIAL CONTROL B | LOW | LARGE (SHb) | ABSENCE | ABSENCE |
| SPECIAL CONTROL C | MEDIUM | SMALL (SHs) | PRESENCE | ABSENCE |
| SPECIAL CONTROL D | HIGH | 0 | PRESENCE | PRESENCE |

MAIN-SCANNING SPEED "MEDIUM"
(PRESENCE OF SHIFT (EXEMPLARY EMBODIMENT))

MAIN-SCANNING SPEED "MEDIUM"
(ABSENCE OF SHIFT (COMPARATIVE EXAMPLE))

MAIN-SCANNING SPEED "LOW"
(PRESENCE OF SHIFT (EXEMPLARY EMBODIMENT))

SHIFT AMOUNT SETTING TABLE SFT

| PREVIOUS MAIN-SCANNING SPEED | MAIN-SCANNING SPEED | PRINTING DIRECTION | SHIFT AMOUNT |
|---|---|---|---|
| HIGH | MEDIUM | UNIDIRECTIONAL | SHA |
| HIGH | MEDIUM | BIDIRECTIONAL | SHB |
| HIGH | LOW | UNIDIRECTIONAL | SHC |
| HIGH | LOW | BIDIRECTIONAL | SHD |
| MEDIUM | LOW | UNIDIRECTIONAL | SHE |
| MEDIUM | LOW | BIDIRECTIONAL | SHF |

TEST IMAGE TI

PRINTING DEVICE AND CONTROL METHOD

CROSS-REFERENCE TO RELATED APPLICATIONS

This application claims priority from Japanese Patent Application No. 2018-131690 filed on Jul. 11, 2018, the entire subject matter of which is incorporated herein by reference.

TECHNICAL FIELD

The present specification relates to an image processing of a printing execution unit that performs printing, in which partial printing to discharge ink while performing main-scanning and sub-scanning are executed multiple times.

BACKGROUND ART

A printer which prints an image by discharging ink from a nozzle of a print head are known. In these printers, for example, when temperature of the ink is relatively low, viscosity of the ink becomes high and thus, a delay in supply of ink from an ink storage unit to the print head may be likely to occur. If the delay in the supply of ink occurs, image quality is degraded due to, for example, a color of the printed image being lightened.

In the background art, a printer that reduces a drive frequency and carriage speed of the print head in case where the number of dots counted in a band exceeds a threshold value according to temperature of the print head is disclosed.

SUMMARY

However, in the printer, although the delay in the supply of ink can be suppressed, dot deviation occurs between a band printed at a high carriage speed and a band printed at a low carriage speed and degradation in image quality occurs, in some cases.

The present specification discloses a technique capable of suppressing the degradation in image quality in order to suppress the delay in the supply of ink while suppressing the delay in the supply of ink.

The technique disclosed in the present specification can be realized as the following application example.

According to application example 1, a printing device includes: a print head that includes a plurality of nozzles to discharge ink; an ink supply unit configured to supply the ink to the print head; a main-scanning unit configured to perform main-scanning in which the print head is moved with respect to a print medium; a sub-scanning unit configured to perform sub-scanning in which the print medium is moved along a direction intersecting a direction of the main-scanning with respect to the print head; and a controller configured to perform printing, in which partial printing that causes the print head to discharge the ink while controlling the main-scanning unit to perform the main-scanning and the sub-scanning by the sub-scanning unit are executed multiple times. A first condition indicates that the supply of the ink from the ink supply unit to the print head in the partial printing is likely to be delayed, and a satisfaction of the first condition is determined by the partial printing basis. In a first case where a first condition is not satisfied, in the partial printing, the controller controls the main-scanning unit to perform the main-scanning at a first speed and controls the print head to discharge the ink to correspond to a specific pixel of a partial image to be printed by the partial printing when the print head is at a first position in the direction of the main-scanning. In a second case where the first condition is satisfied, in the partial printing, the controller controls the main-scanning unit to perform the main-scanning at a second speed slower than the first speed and controls the print head to discharge the ink to correspond to the specific pixel when the print head is at a second position, which is located at a downstream of the first position in the direction of the main-scanning.

According to the configuration described above, in the second case where the first condition indicating that the supply of ink from the ink supply unit to the print head may be delayed in partial printing is satisfied, the controller controls the main-scanning to be performed at a second speed slower than the first speed. As a result, the delay in the supply of ink can be suppressed. Furthermore, in the second case, the controller controls to discharge the ink corresponding to the specific pixel when the print head is at the second position downstream of the first position in the direction of the main-scanning. As a result, it is possible to suppress deviation of positions of dots formed by ink in an image to be printed due to the reduction in the speed of the main-scanning. Accordingly, it is possible to suppress the degradation in image quality in order to suppress the delay in the supply of ink while suppressing the delay in the supply of ink.

The technology disclosed in the present specification can be realized in various forms, for example, a printing apparatus, a control method of a printing execution unit, a printing method, and a computer program for realizing functions of these apparatuses and methods, and a recording medium recorded therein the computer program, and the like.

BRIEF DESCRIPTION OF DRAWINGS

FIGS. 7A, 7B, and 7C are diagrams illustrating exemplary embodiments of tables included in a control table group (FIG. 1);

DETAILED DESCRIPTION

A. First Exemplary Embodiment

A-1: Configuration of Printer 200

Figure 1:
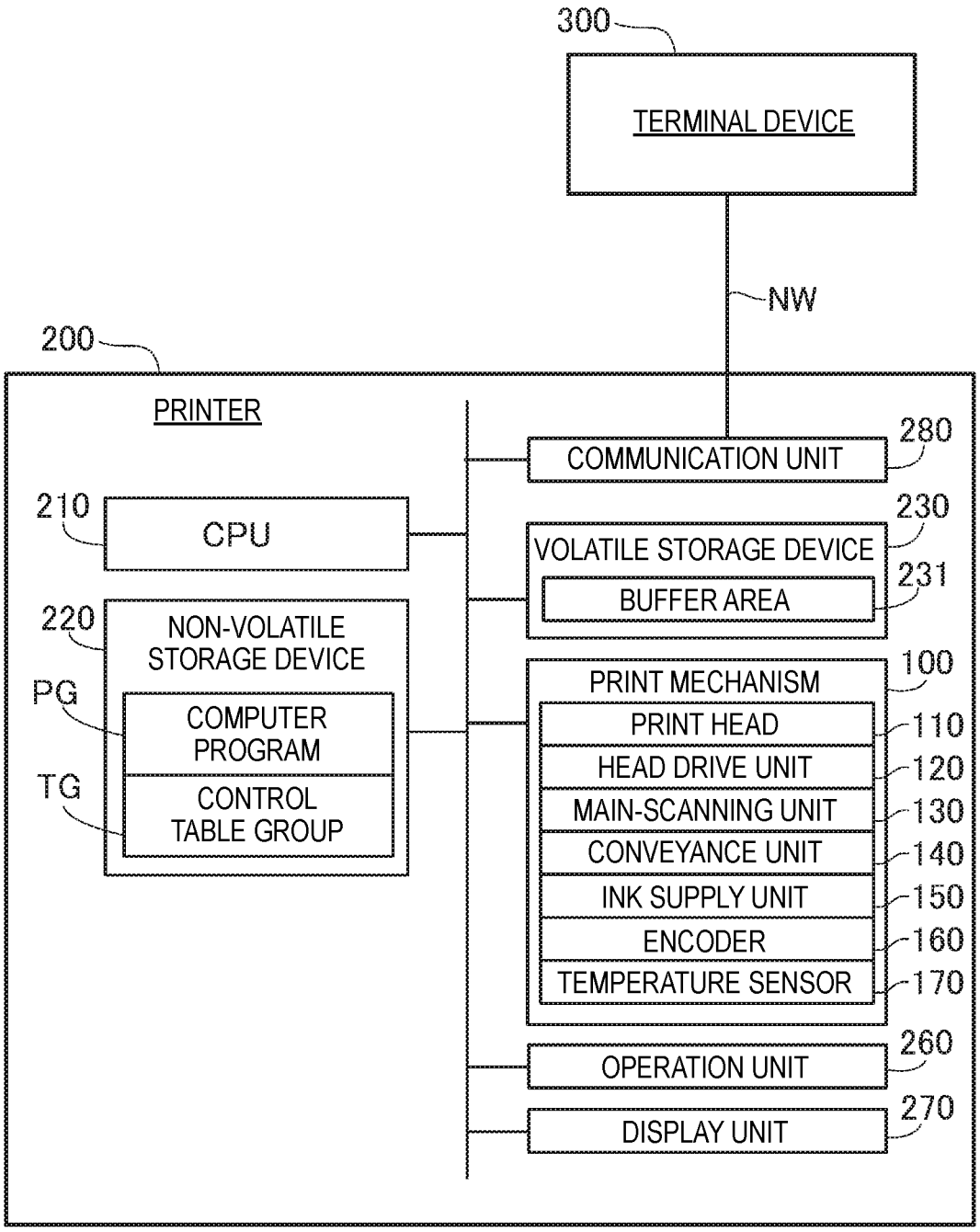
FIG. 1 is a block diagram illustrating a configuration of a printer of an exemplary embodiment.

Next, an embodiment will be described based on an exemplary embodiment. FIG. 1 is a block diagram illustrating a configuration of a printer 200 of the exemplary embodiment.

The printer 200 includes, for example, a print mechanism 100, a CPU 210 as a controller of the printer 200, a non-volatile storage device 220 such as a hard disk drive, a volatile storage device 230 such as a RAM, an operation unit 260 such as a button or a touch panel for acquiring an operation by the user, a display unit 270 such as a liquid crystal display, and a communication unit 280. The communication unit 280 includes a wired or wireless interface for connecting to a network NW. The printer 200 is communicably connected to an external device, for example, a terminal device 300 via the communication unit 280.

The volatile storage device 230 provides a buffer area 231 for temporarily storing various intermediate data generated when the CPU 210 performs a process. In the non-volatile storage device 220, a computer program PG and a control table group TG are stored. In this exemplary embodiment, the computer program PG is a control program for controlling the printer 200. The computer program PG and the control table group TG may be provided by being stored in the non-volatile storage device 220 when the printer 200 is shipped. Alternatively, the computer program PG and the control table group TG may be provided in the form of being downloaded from a server, or may be provided in the form of being stored in a DVD-ROM or the like. The CPU 210 executes, for example, a printing process described later by executing the computer program PG. With this configuration, the CPU 210 controls the print mechanism 100 to print an image on a print medium (for example, paper).

The print mechanism 100 performs printing by discharging each of inks (droplets) of cyan (C), magenta (M), yellow (Y), and black (K). The print mechanism 100 includes a print head 110, a head drive unit 120, a main-scanning unit 130, a conveyance unit 140, an ink supply unit 150, an encoder 160, and a temperature sensor 170.

Figure 2:
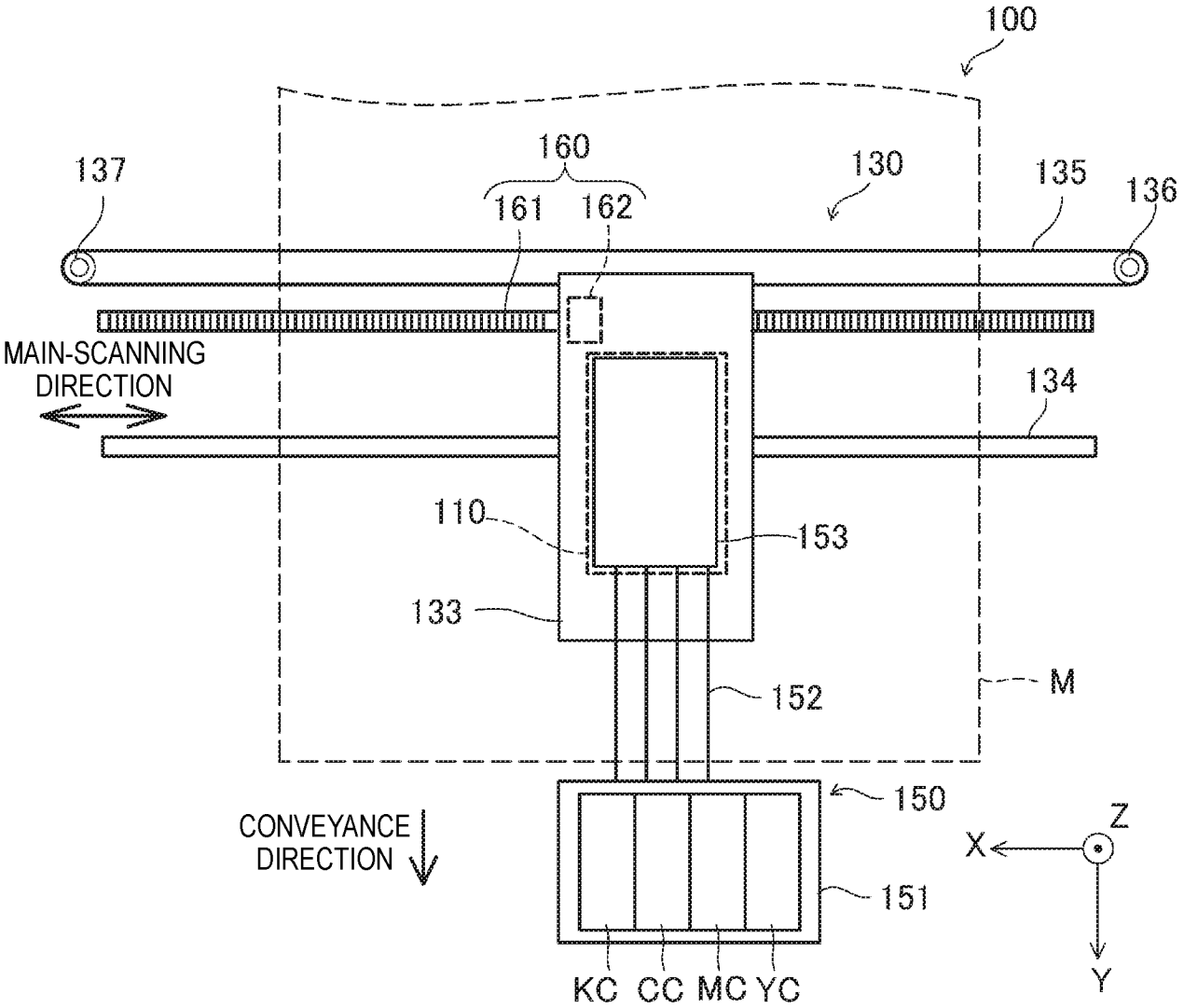
FIG. 2 is a diagram illustrating a schematic configuration of a print mechanism.

FIG. 2 is a diagram illustrating a schematic configuration of the print mechanism 100. As illustrated in FIG. 2, the main-scanning unit 130 includes a carriage 133, a sliding shaft 134, a belt 135, and a plurality of pulleys 136 and 137. The print head 110 is mounted on the carriage 133. The sliding shaft 134 holds the carriage 133 so as to be capable of reciprocating along a main-scanning direction (X-axis direction in FIG. 2). The belt 135 is wound around the pulleys 136 and 137, and a part of the belt 135 is fixed to the carriage 133. The pulley 136 is rotated by power of a main-scanning motor (not illustrated). When the main-scanning motor rotates the pulley 136, the carriage 133 moves along the sliding shaft 134. With this configuration, main-scanning for reciprocating the print head 110 along the main-scanning direction with respect to paper M is realized.

The conveyance unit 140 conveys the paper M in a conveyance direction (+Y-direction in FIG. 2) while holding the paper M. Hereinafter, an upstream side (−Y side) in the conveyance direction is simply referred to as an upstream side, and a downstream side (+Y side) in the conveyance direction is simply referred to as a downstream side. Although detailed illustration is omitted, the conveyance unit 140 includes an upstream roller pair that holds the paper M on the upstream side of the print head 110, a downstream roller pair that holds the paper M on the downstream side of the print head 110, and a motor. The conveyance unit 140 conveys the paper M by driving these rollers with power of a motor.

The ink supply unit 150 supplies ink to the print head 110. The ink supply unit 150 includes a cartridge mounting unit 151, a tube 152, and a buffer tank 153. A plurality of ink cartridges KC, CC, MC, and YC, which are containers containing ink therein, are detachably mounted on the cartridge mounting unit 151, and the ink is supplied from these ink cartridges. The buffer tank 153 is disposed above the print head 110 in the carriage 133 and temporarily stores the ink to be supplied to the print head 110 for each of CMYK inks. The tube 152 is a flexible tube serving as a flow path of ink connecting a cartridge mounting unit 251 and the buffer tank 153. The ink in each ink cartridge is supplied to the print head 110 through the cartridge mounting unit 151, the tube 152, and the buffer tank 153. The buffer tank 153 is provided with a filter (not illustrated) for removing foreign matter mixed in the ink.

Figure 3:
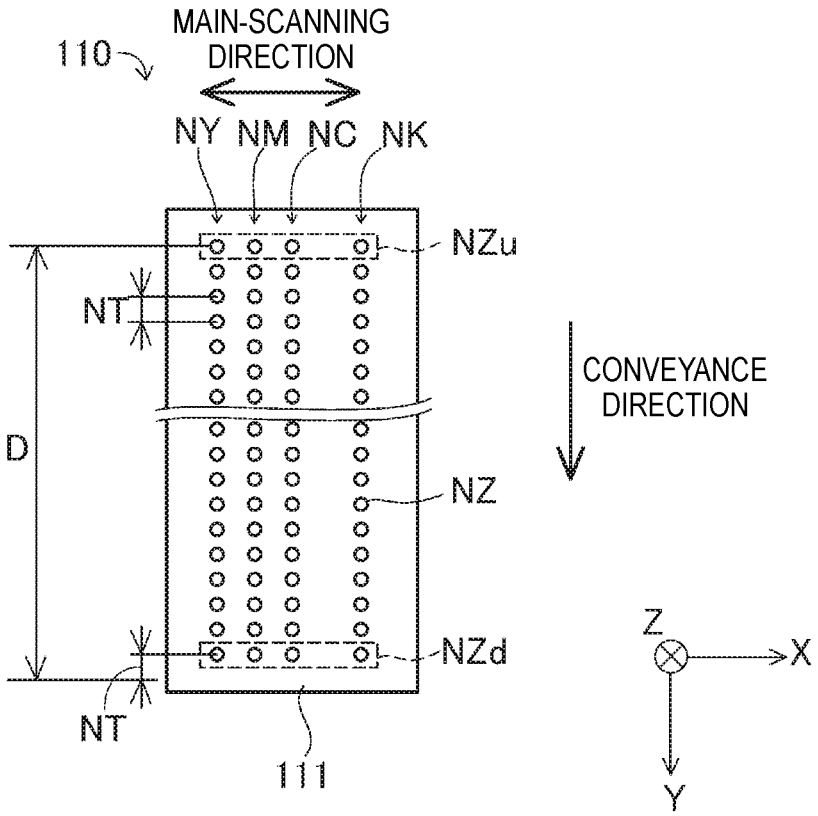
FIG. 3 is a diagram illustrating a configuration of the print head when viewed from −Z side.

FIG. 3 is a diagram illustrating a configuration of the print head 110 when viewed from the −Z side. As illustrated in FIG. 3, a nozzle formation surface 111 of the print head 110 is a surface facing the paper M conveyed by the conveyance unit 140. On the nozzle formation surface 111, a plurality of nozzle rows consisting of a plurality of nozzles NZ, that is, nozzle rows NC, NM, NY, and NK for respectively discharging C, M, Y, and K inks described above are formed. Each nozzle row includes a plurality of nozzles NZ. The plurality of nozzles NZ have different positions in the conveyance direction (+Y-direction), and are arranged at predetermined nozzle intervals NT along the conveyance direction. The nozzle interval NT is a length in the conveyance direction between two nozzles NZ adjacent in the conveyance direction among the plurality of nozzles NZ. Among the nozzles constituting these nozzle rows, a nozzle NZ positioned on the most upstream side (−Y side) is also referred to as the most upstream nozzle NZu. Among these nozzles, the nozzle NZ positioned on the most downstream side (+Y side) is referred to as the most downstream nozzle NZd. A length obtained by adding the nozzle interval NT to a length from the most upstream nozzle NZu to the most downstream nozzle NZd in the conveyance direction is also referred to as a nozzle length D.

The positions of the nozzle rows NC, NM, NY, and NK in the main-scanning direction are different from each other, and the positions in a sub-scanning direction overlap each other. For example, in the exemplary embodiment of FIG. 3, the nozzle row NM is disposed in the +X-direction of the nozzle row NY that discharges Y ink.

Each nozzle NZ is connected to the buffer tank 153 via an ink flow path (not illustrated) formed inside the print head 110. Actuators (not illustrated) for discharging the ink along the respective ink flow paths inside the print head 110 are provided.

The head drive unit 120 (FIG. 1) drives each actuator in the print head 110 according to print data supplied from the CPU 210 during main-scanning by the main-scanning unit 130. With this configuration, ink is discharged from the nozzles NZ of the print head 110 onto the paper M conveyed by the conveyance unit 140 to form dots. A configuration of the head drive unit 120 will be described later.

The encoder 160 is a device that detects the position of the print head 110 in the main-scanning direction and is a so-called linear encoder. As illustrated in FIG. 2, the encoder 160 includes a linear scale 161 and an optical sensor 162. The linear scale 161 is a strip-shaped member extending in the main-scanning direction and is fixed in a casing. In the linear scale 161, transmission portions that transmit light along the longitudinal direction and non-transmission portions that do not transmit light are alternately formed. As illustrated in FIG. 2, the optical sensor 162 is mounted on the carriage 133 and moves together with the print head 110 during main-scanning. The optical sensor 162 includes a light emitting element and a light receiving element, and the linear scale 161 is disposed between the light emitting element and the light receiving element. During main-scanning in which the carriage 133 (print head 110) moves in the main-scanning direction, the matters that light emitted from the light emitting element is transmitted through the transmitting portions of the linear scale 161 and received by the light receiving element and the matters that light emitted from the light emitting element is blocked by the non-transmitting portions and not received by the light receiving element are alternately repeated. The encoder 160 outputs a pulse signal indicating a change in light received by the light receiving element of the optical sensor 162. Since the position of the carriage 133 in the main-scanning direction can be obtained based on the pulse signal, the pulse signal can be said to be a position signal indicating the position of the carriage 133 in the main-scanning direction. The position signal output from the encoder 160 is supplied to, for example, the main-scanning unit 130 and the head drive unit 120 and is used for control of main-scanning and the print head 110.

The temperature sensor 170 is a known temperature sensor including a resistance temperature detector and the like and is installed near the print head 110 of the printer 200. The temperature sensor 170 outputs a signal indicating temperature of the print head 110 of the printer 200.

A-2. Outline of Printing

The CPU 210 alternately executes partial printing by controlling the print head 110 to discharge the ink to form dots on the paper M while controlling the main-scanning unit 130 to perform main-scanning and sub-scanning (conveyance of the paper M) by the conveyance unit 140 multiple times, thereby allowing a print image to be printed on the paper M.

Figure 4:
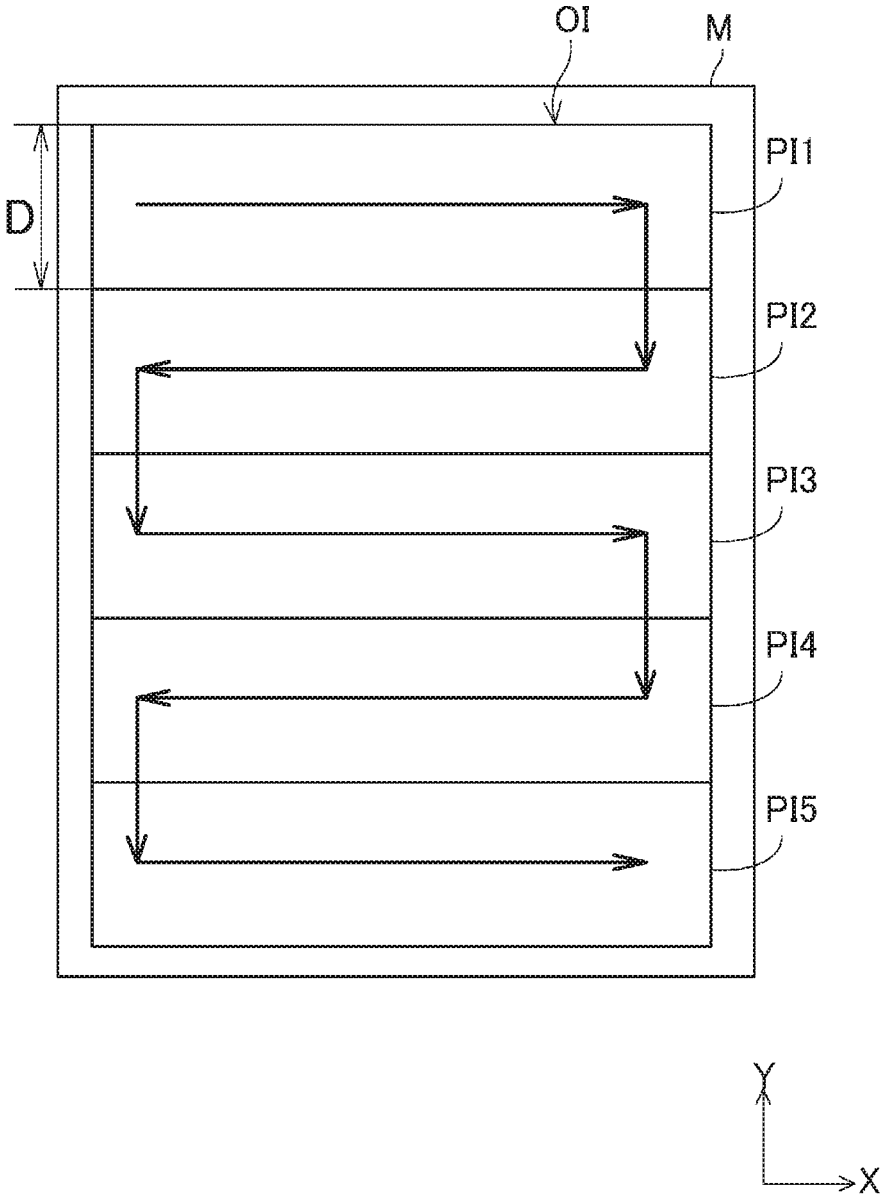
FIG. 4 is an explanatory diagram of an operation of the print mechanism.

FIG. 4 is an explanatory diagram of the operation of the print mechanism 100. In FIG. 4, a print image OI printed on the paper M is illustrated. The print image OI includes a plurality of partial images PI1 to PI5. Each partial image is an image printed by single partial printing. A printing direction of partial printing is one of a forward direction and a backward direction. That is, the partial printing is any of forward printing in which dots are formed while main-scanning is performed in the forward direction (+X-direction in FIG. 4) and backward printing in which dots are formed while main-scanning is performed in the backward direction (−X-direction in FIG. 4). In FIG. 4, solid arrows in the +X-direction or the −X-direction are attached to the partial images. The partial images PI1, PI3, and PI5 to which the solid arrows in the +X-direction are attached are forward partial images printed by the forward printing. The partial images PI2 and PI4 to which the solid arrows in the −X-direction are attached are backward partial images printed by backward printing.

As illustrated in FIG. 4, printing of this exemplary embodiment is bidirectional printing in which forward printing and backward printing are alternately performed. Bidirectional printing can reduce printing time, for example, as compared to unidirectional printing in which only forward printing is repeatedly performed. This is because, in unidirectional printing, the print head 110 needs to be moved in the backward direction without performing partial printing in order to perform forward printing again after forward printing but in bidirectional printing, the print head 110 does not need to be moved in the backward direction.

In FIG. 4, the arrow in the −Y-direction from one partial image (for example, partial image PI1) to another partial image (for example, partial image PI2) adjacent in the −Y-direction corresponds to conveyance (sub-scanning) of the paper M. That is, the arrow in the −Y-direction in FIG. 4 indicates that the print head 110 moves in the −Y-direction with respect to the paper M illustrated in FIG. 4 by the paper M being conveyed. As illustrated in FIG. 4, printing of this exemplary embodiment is so-called one pass printing, and the length of each partial image in the conveyance direction and a conveyance amount of the paper M at one time are the nozzle length D.

Here, when ink is discharged from the nozzle NZ during printing, the ink in the buffer tank 153 (FIG. 2) is reduced by the amount of the discharged ink and thus, negative pressure is generated in the buffer tank 153. The ink is supplied from the ink cartridge to the buffer tank 153 through the cartridge mounting unit 151 and the tube 152 by the negative pressure. When a large amount of ink is discharged from the plurality of nozzles NZ within a short time for printing, a delay in the supply of ink to the buffer tank 153 may occur. When such a delay in the supply of ink occurs, a defect that the ink is not discharged from the nozzle NZ even when the actuator is driven or a defect that only a smaller amount of ink than expected is discharged occurs. When such a defect occurs, a color is lightened and image quality is degraded in the printed image OI.

A delay in the supply of ink is likely to occur when fluidity of the ink decreases. For example, as temperature (hereinafter, also referred to as head temperature Th) of the print head 110 of the printer 200 (print mechanism 100) becomes lower, a delay in the supply of ink is more likely to occur. This is because that the viscosity of the ink becomes higher as the head temperature Th becomes lower and thus, the fluidity of the ink becomes lower. Here, a cumulative ink use amount TA is an index value indicating the cumulative use amount of a specific ink (any of C, M, Y, and K) from the time of manufacture of the printer 200 to the present. As the cumulative ink use amount TA becomes larger, the delay in the supply of ink is more likely to occur. This is because that a deposition amount of foreign matter becomes larger in the filter for removing foreign matter in the ink as the cumulative ink use amount TA becomes larger and thus, flow path resistance of the ink increases and fluidity of the ink decreases. A pass ink use amount PA is an index value indicating the use amount of a specific ink used for printing a partial image in single partial printing. As the pass ink use amount PA becomes larger, a delay in the supply of a specific ink is more likely to occur. This is because that a specific ink is used in a short time and thus, the supply of the specific ink does not easily catch up. In the printing process described below, contrivance for suppressing the delay in the supply of ink and contrivance for suppressing degradation in image quality in order to suppress the delay in the supply of ink are made.

A-3. Printing Process

Figure 5:
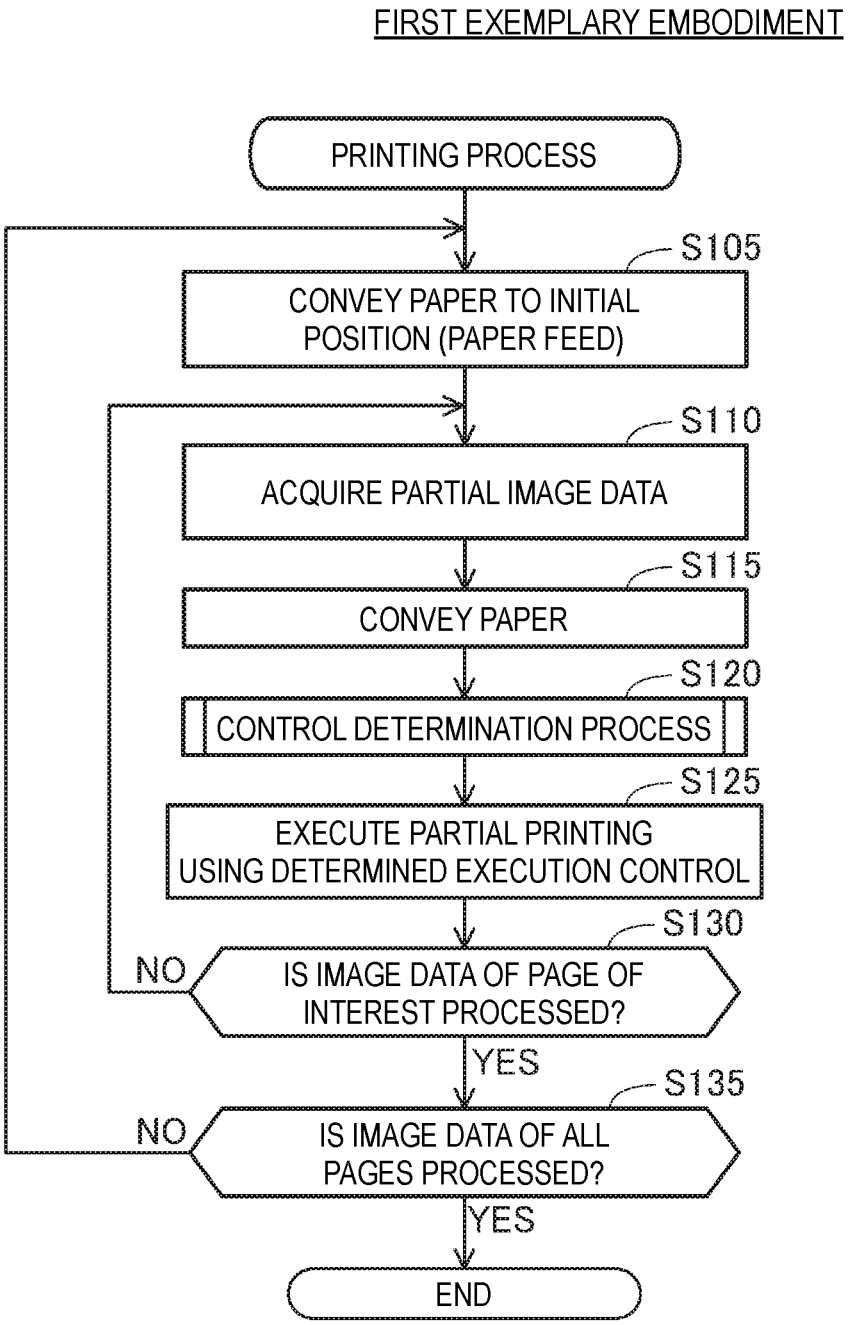
FIG. 5 is a flowchart of a printing process according to a first exemplary embodiment.

FIG. 5 is a flowchart of a printing process of the first exemplary embodiment. For example, when a print instruction is received from the terminal device 300, the CPU 210 of the printer 200 starts the printing process. Alternatively, the CPU 210 may start the printing process when the print instruction is obtained from a user via the operation unit 260. The print instruction includes designation of image data indicating an image to be printed.

In S105, the CPU 210 controls the conveyance unit 140 to convey one sheet of paper M from a print tray (not illustrated) to a predetermined initial position.

In S110, the CPU 210 acquires partial image data corresponding to a partial image to be printed in single partial printing as partial image data of interest, and stores the partial image data in a buffer area 331. For example, the CPU 210 receives partial image data of interest from the terminal device 300 to acquire the partial image data of interest. In this exemplary embodiment, the partial image data of interest is data (also referred to as dot data) indicating a dot formation state for each color component and for each pixel. The dot formation state is, for example, any of "presence of dot" and "absence of dot". Alternatively, the dot formation state may be any of a "large dot", a "medium dot", a "small dot", and the "dot absence". In a modified example, the CPU 210 may acquire the partial image data of interest by generating the partial image data of interest using image data stored in the volatile storage device 230. For example, image processing including color conversion processing and halftone processing is performed on data corresponding to the partial image, among image data, to generate the partial image data of interest.

The partial image indicated by the partial image data of interest is also referred to as a partial image of interest. Partial printing for printing the partial image of interest is also referred to as partial printing of interest.

In S110, the CPU 210 controls the conveyance unit 140 to convey the paper M such that the position of the print head 110 with respect to the paper M in the conveyance direction is a position where the partial image of interest is to be printed.

In S120, the CPU 210 executes a control determination process. The control determination process is a process of determining control (also referred to as execution control) to be executed in the partial printing of interest from among a plurality of types of controls for performing partial printing. One execution control is determined from among five types of controls (normal control and special controls A to D) described later by the control determination process.

Figure 6:
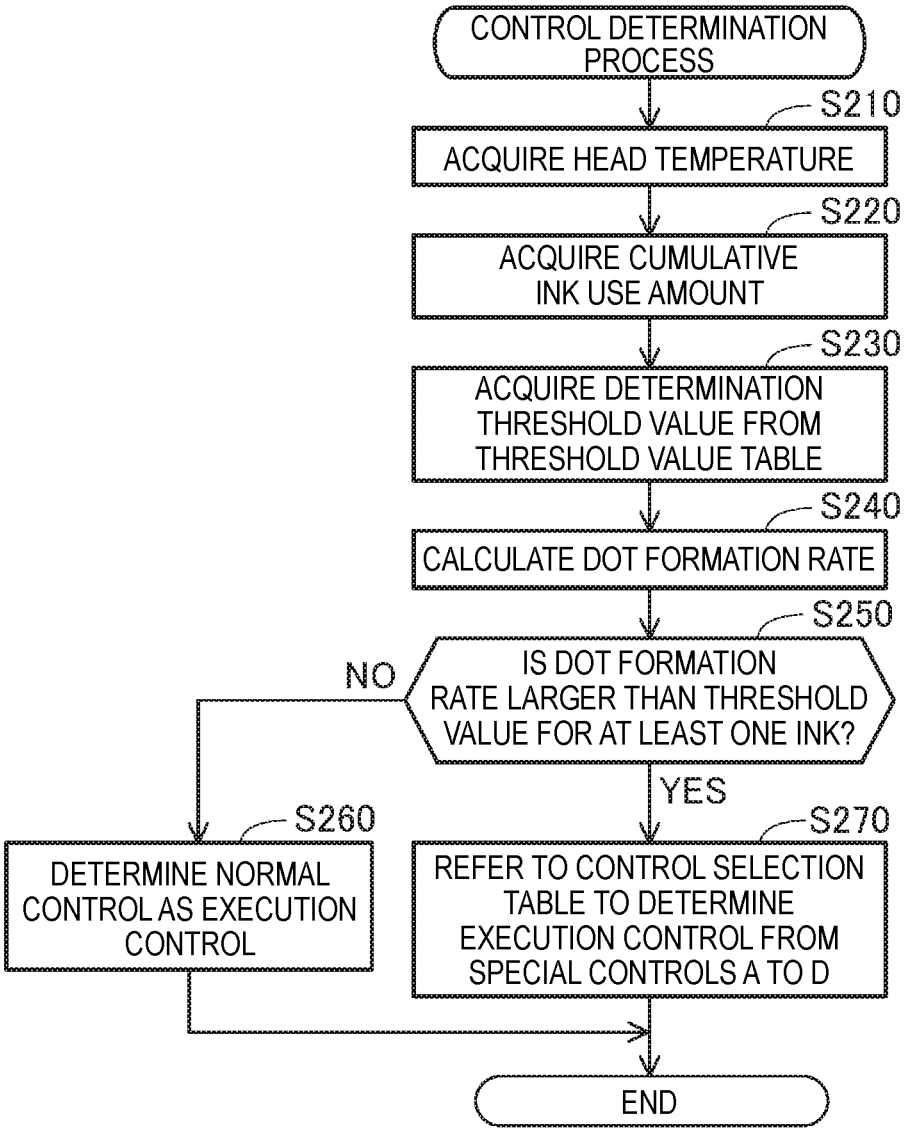
FIG. 6 is a flowchart of a control determination process.

FIG. 6 is a flowchart of the control determination process. FIGS. 7A, 7B, and 7C are diagrams illustrating examples of tables included in the control table group TG (FIG. 1). When the control determination process is started, the CPU 210 acquires head temperature Th of the print head 110 of the printer 200 based on a signal from the temperature sensor 170 in S210.

In S220, the CPU 210 acquires the cumulative ink use amount TA of each ink used for printing from the non-volatile storage device 220. Each cumulative ink use amount TA is recorded in a predetermined area of the non-volatile storage device 220 for each of CMYK inks. Every time printing is performed, the CPU 210 updates the cumulative ink use amount TA by calculating the use amount of ink of each color based on, for example, the number of dots formed by printing. In this step, for example, in a case of monochrome printing, the cumulative ink use amount TA of K ink is acquired, and in a case of color printing, the cumulative ink use amount TA of each of CMYK inks is acquired.

In S230, the CPU 210 acquires a determination threshold value JT corresponding to each ink used for printing from a threshold value table TT based on the head temperature Th and the cumulative ink use amount TA. In FIG. 7A, an exemplary embodiment of the threshold value table TT is illustrated. In the threshold value table TT, corresponding determination threshold values JT are recorded for a combination of the head temperature Th and the cumulative ink use amount TA. For example, in the exemplary embodiment of FIG. 7A when the acquired head temperature Th is within a range of "middle" determined in advance and the cumulative ink use amount TA acquired for a specific ink is within a range of "large" determined in advance, "75%" is acquired as the determination threshold value JT corresponding to the specific ink. In the case of monochrome printing, the determination threshold value JT corresponding to the K ink is acquired, and in the case of color printing, the determination threshold value JT corresponding to each of CMYK inks is acquired.

As illustrated in FIG. 7A, in the threshold value table TT, the determination threshold value JT is set lower as the cumulative ink use amount TA becomes larger. As the head temperature Th is lower, the determination threshold value JT is set lower.

In S240, the CPU 210 calculates a dot formation rate DR of each ink used for printing, using the partial image data of interest. The dot formation rate DR is a ratio of dot pixels to the total number of pixels of the partial image of interest. The dot pixel is a pixel having a value indicating formation of a dot in the partial image data of interest. The pass ink use amount PA becomes larger as the dot formation rate DR becomes higher and thus, the dot formation rate DR is an index value indicating the pass ink use amount PA. In the case of monochrome printing, the dot formation rate DR corresponding to K ink is calculated, and in the case of color printing, the dot formation rate DR corresponding to each of CMYK inks is calculated.

In S250, the CPU 210 determines whether or not the dot formation rate DR is larger than the determination threshold value JT for at least one ink used for printing. When it is determined that the dot formation rate DR is larger than the determination threshold value JT, a large amount of ink is discharged in a short time and therefore, the delay in the supply of ink may occur. When it is determined that the dot formation rate DR is larger than the determination threshold value JT for at least one ink used for printing (YES in S250), the CPU 210 refers to a control selection table ST to determine execution control from special controls A to D, in S270.

In FIG. 7B, an exemplary embodiment of the control selection table ST is illustrated. In the control selection table ST, corresponding execution control (any of special controls A to D) is recorded for a combination of the head temperature Th, the cumulative ink use amount TA, and the dot formation rate DR. In FIG. 7B, a first table ST1 and a second table ST2 of the control selection table ST are representatively illustrated. In the first table ST1, execution control to be determined according to the determination threshold value JT when the cumulative ink use amount TA is "small" and the head temperature Th is "low" is recorded. In the second table ST2, execution control to be determined according to the determination threshold value JT when the cumulative ink use amount TA is "large" and the head temperature Th is "low" is recorded.

Although the details will be described later, in order of special control D, special control C, special control B, special control A, and normal control, the supply of ink is less likely to be delayed, that is, the delay in the supply of ink can be further suppressed. As illustrated in FIG. 7B, each control selection table ST (for example, tables ST1 and ST2) is set such that control with which the supply of ink is less likely to be delayed is selected as the dot formation rate DR becomes higher (FIG. 7B). As understood by comparing the first table ST1 and the second table ST2, if the dot formation rate DR is the same, the control selection table ST is set such that control with which the supply of ink is less likely to be delayed is selected as the cumulative ink use amount TA becomes larger (FIG. 7B). Although illustration is omitted, if the dot formation rate DR is the same, the control selection table ST is set such that control with which the supply of ink is less likely to be delayed is selected as the head temperature Th becomes lower.

Although illustration is omitted, corresponding control selection table ST is prepared for each of the following four cases.

(1) When the cumulative ink use amount TA is "small" and the head temperature Th is "medium", (2) When the cumulative ink use amount TA is "medium" and the head temperature Th is "medium", (3) When the cumulative ink use amount TA is "large" and the head temperature Th is "medium", and (4) When the cumulative ink use amount TA is "medium" and the head temperature Th is "low".

When the head temperature Th is "medium", since the corresponding determination threshold value JT is "100%" and the dot formation rate DR does not become larger than 100%, the corresponding control selection table ST is not prepared.

As illustrated in FIG. 7B, for example, when the cumulative ink use amount is "small", the head temperature Th is "low", and the dot formation rate DR is 85%, the special control B is determined as execution control. When the cumulative ink use amount is "small", the head temperature Th is "low", and the dot formation rate DR is 100%, the special control D is determined as execution control.

For example, in the case of monochrome printing, execution control determined for the K ink is determined as it is as final execution control. In the case of color printing, execution control is determined for each of CMYK inks. Then, among execution controls for inks, control that can suppress the delay in the supply of ink most is determined as final execution control. For example, when execution control of each of K, M, and Y inks is determined to be the special control A and execution control of the C ink is determined to be the special control C, the special control C capable of suppressing the delay in the supply of ink as compared to the special control A is determined as final execution control.

When it is determined that the dot formation rate DR is less than or equal to the determination threshold value JT for all the inks used for printing (NO in S250), the CPU 210 determines normal control as execution control in S260. When execution control is determined in S260 or S270, the control determination process is ended.

When the control determination process is ended, in S125 of FIG. 5, the CPU 210 refers to a control condition table CT of FIG. 7C and executes partial printing using determined execution control. With this configuration, the partial image of interest is printed on the paper M by the print mechanism 100. The control condition table CT of FIG. 7C will be described later.

In S130, the CPU 210 determines whether or not the image data of a page to be processed has been processed. In other words, it is determined whether or not printing of a print image indicating the page to be processed has been completed. When it is determined that image data of the page to be processed is processed (YES in S130), the CPU 210 makes the printing process to proceed to S135. When it is determined that there is unprocessed image data for the page to be processed (NO in S130), the CPU 210 returns to S110.

In S135, the CPU 210 determines whether or not image data of all pages to be printed has been processed. When it is determined that the image data of all pages has been processed (YES in S135), the CPU 210 ends the printing process. When it is determined that there is unprocessed image data (NO in S135), the CPU 210 returns to S105.

A-4. Control of Partial Printing

Five types of control of partial printing (normal control and special controls A to D) will be described. In the control condition table CT of FIG. 7C, control conditions of each of these controls are recorded. As illustrated in the control condition table CT, each control is different in at least one of a main-scanning speed SS, the shift amount SH, the presence or absence of weight, and the presence or absence of division.

The main-scanning speed SS is a speed at which the print head 110 moves in the main-scanning direction in the main-scanning when partial printing is performed. The main-scanning speed SS is set to one of three levels of high, medium, and low in order of speed (FIG. 7C). The main-scanning speed SS of "medium" is, for example, one-half the main-scanning speed SS of "high". The main-scanning speed SS of "low" is, for example, the speed which is one-half the main-scanning speed SS of "medium". As the main-scanning speed SS becomes slower, it is possible to suppress discharge of a large amount of ink in a short time and thus, it is possible to suppress the delay in the supply of ink.

A shift amount SH is an amount by which a position (also, referred to as a discharge position) in the main-scanning direction in which ink is discharged is shifted from a reference position in partial printing. The reference position is the discharge position when the main-scanning speed SS is "high". Accordingly, as illustrated in FIG. 7C, in the control (for example, the normal control) in which the main-scanning speed SS is "high", the shift amount SH is "0". In the control in which the main-scanning speed SS is "medium" (for example, the special control A), the shift amount SH is "small". In the control in which the main-scanning speed SS is "low" (for example, the special control B), the shift amount SH is "large".

A shift amount SHs of "small" is determined such that a position (also referred to as a formation position) in the main-scanning direction at which dots are formed on the paper M when the partial image is printed at the main-scanning speed SS of "medium" is the same as the dot formation position when the partial image is printed at the main-scanning speed SS of "high".

A shift amount SHb of "large" is determined such that the dot formation position when the partial image is printed at the main-scanning speed SS of "low" is the same as the dot formation position when the partial image is printed at the main-scanning speed SS of "high".

Figure 8A:
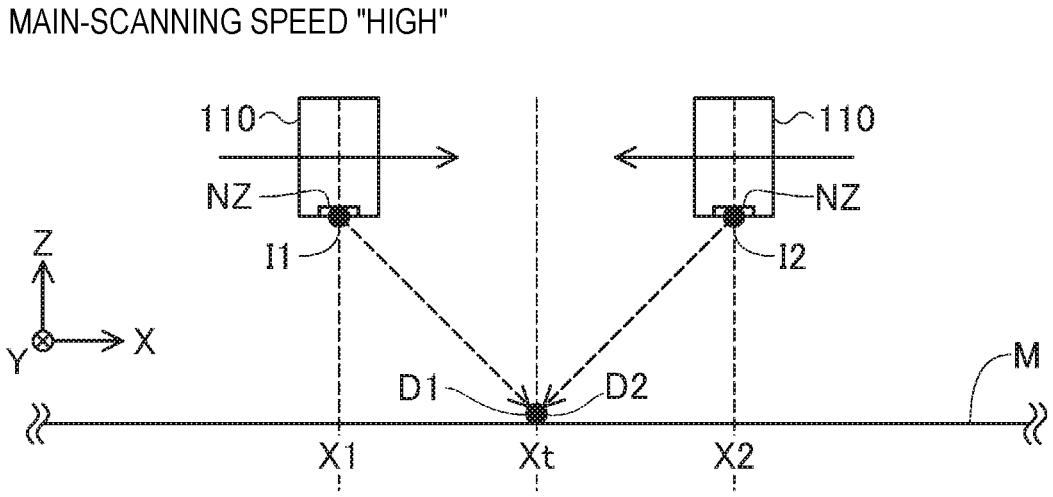
FIGS. 8A, 8B, 8C, and 8D are diagrams for illustrating formation positions of dots.

FIGS. 8A, 8B, 8C, and 8D are diagrams for explaining formation positions of the dots. In FIGS. 8A, 8B, 8C, and 8D, ink I1 is ink corresponding to a first pixel in a partial image printed by the forward printing, and indicates ink discharged from the print head 110 during forward printing. Ink I2 is ink corresponding to a second pixel in the partial image printed in the backward printing, and indicates ink discharged from the print head 110 during the backward printing. In FIG. 8A, a case where the main-scanning speed SS is "high" is illustrated. Since the ink I1 discharged during the forward printing has the speed in the forward direction (+X-direction), the ink I1 lands on the +X side of the discharge position. Since the ink I2 discharged during the backward printing has the speed in the backward direction (−X-direction), the ink I2 lands on the −X side of the discharge position. For this purpose, in order to form a dot D1 at a target position Xt on the paper M, a discharge position X1 is set on the −X side (left side in FIG. 8A) of the target position Xt in the forward printing. In order to form a dot D2 at the target position Xt on the paper M, a discharge position X2 is set on the +X side (right side in FIG. 8A) of the target position Xt in the backward printing.

Figure 8B:
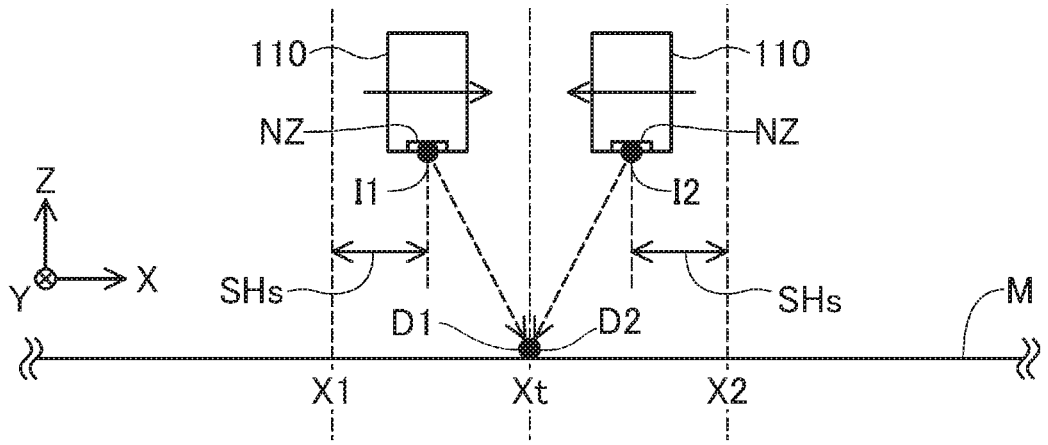
Figure 8C:
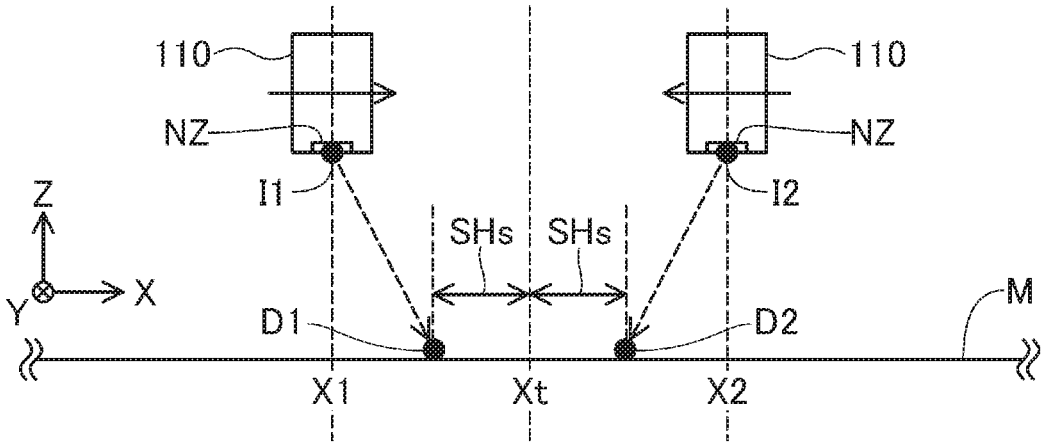

In FIGS. 8B and 8C, the case where the main-scanning speed SS is "medium" is illustrated. In FIG. 8B, an example (this exemplary embodiment) in which the discharge position is shifted in the main-scanning direction by the shift amount SHs of "small" as compared to the case where the main-scanning speed SS is "high" (FIG. 8A) is illustrated. In FIG. 8C, an example in which the discharge position is the same as in the case where the main-scanning speed SS is "high" (FIG. 8A), that is, an example (comparative example) in which the discharge position is not shifted is illustrated.

When the main-scanning speed SS is "medium", the speed in the forward direction or backward direction of the inks I1 and I2 is smaller than that when the main-scanning speed SS is "high". For this purpose, as illustrated in FIG. 8B, in this exemplary embodiment, when the main-scanning speed SS is "medium", in the forward printing, the discharge position is shifted in the forward pass direction by an appropriate shift amount SH (that is, a shift amount SHs of "small" (FIG. 7C) as compared to the case where the main-scanning speed SS is "high". When the main-scanning speed SS is "medium", in the backward printing, the discharge position is shifted in the backward direction by the shift amount SHs, as compared to the case where the main-scanning speed SS is "high". As a result, even when the main-scanning speed SS is "medium", dots D1 and D2 can be formed at the same target position Xt as when the main-scanning speed SS is "high".

If the discharge position is not shifted as illustrated in FIG. 8C, the dot D1 is formed on the −X side of the target position Xt in the forward printing and the dot D2 is formed on the +X side of the target position Xt in the backward printing. For that reason, when the discharge position is not shifted, deviation of the dot formation position occurs between the partial image printed at the main-scanning speed SS of "high" and the partial image printed at the main-scanning speed SS of "medium", and image quality of the printed image is degraded.

Figure 8D:
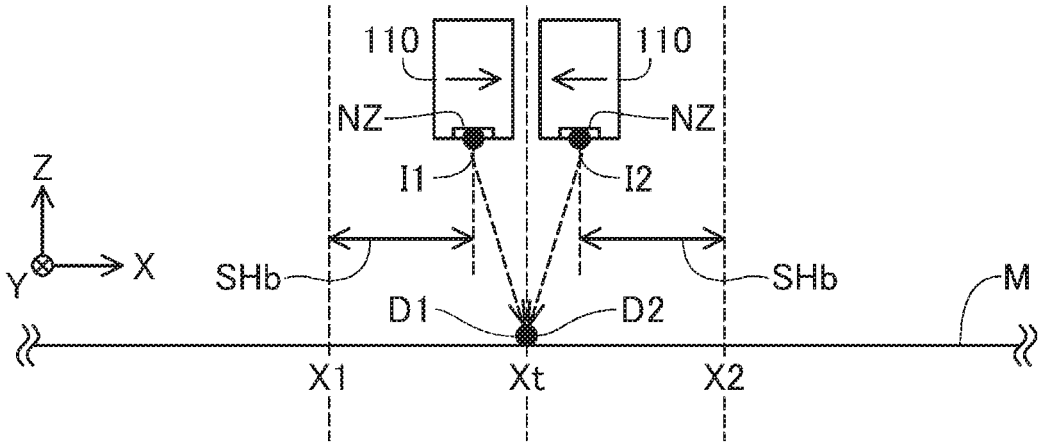

In FIG. 8D, a case where the main-scanning speed SS is "low" is illustrated. When the main-scanning speed SS is "low", the speed in the forward direction or backward direction of the inks I1 and I2 is smaller than that when the main-scanning speed SS is "medium". For this purpose, as illustrated in FIG. 8D, in this exemplary embodiment, when the main-scanning speed SS is "low", in the forward printing, the discharge position is shifted in the forward direction by the shift amount SHb larger than that when the main-scanning speed SS is "medium". When the main-scanning speed SS is "low", in the backward printing, the discharge position is shifted in the backward direction by the shift amount SHb larger than that when the main-scanning speed SS is "medium". As a result, even when the main-scanning speed SS is "low", dots D1 and D2 may be formed at the same target position Xt as when the main-scanning speed SS is "high" or "medium".

In the control in which the weight is "presence", waiting is performed for a slight wait time (for example, about one second) before partial printing. By providing a waiting period, the supply of ink proceeds during that period and thus, it is possible to suppress occurrence of a delay in the supply of ink. In the control in which the weight is "absence", such waiting is not performed before partial printing.

In the control in which the division is "presence", one partial image of interest whose length in the conveyance direction is the nozzle length D is printed by being divided into two partial printings. In the division of this exemplary embodiment, for example, when the partial printing of interest is forward printing, the partial image of interest is printed by two forward printings. Specifically, a half image on the downstream side of the partial image of interest is printed in first forward printing using (D/2) nozzles NZ on the downstream side. Thereafter, the print head 110 is moved in the backward direction without conveying the paper M and without discharging the ink, and the print head 110 is returned from the paper M to the position in the backward direction. Then, using the (D/2) nozzles NZ on the upstream side, another half image on the upstream side of the partial image of interest is printed in second forward printing. When the partial printing of interest is backward printing, the partial image of interest is printed by two backward passes printings. By performing such division, it is possible to suppress the discharge of a large amount of ink in a short time and thus, it is possible to suppress the delay in the supply of ink. In the control in which the division is "absence", one partial image of interest is printed in single partial printing.

In division of a modified example, for example, the half image on the downstream side of the partial image of interest may be printed by the forward printing, and the half image on the upstream side may be printed by the backward printing.

As illustrated in the control condition table CT of FIG. 7C, in the normal control, the main-scanning speed SS is "high", the shift amount SH is "0", and the weight and the division are "absence". In the special control A, the main-scanning speed SS is "medium", the shift amount SH is "small", and the weight and the division are "absence". In the special control B, the main-scanning speed SS is "low", the shift amount SH is "large", and the weight and the division are "absence". In the special control C, the main-scanning speed SS is "medium", the shift amount SH is "small", the weight is "presence", and the division is "absence". In the special control D, the main-scanning speed SS is "high", the shift amount SH is "0", and the weight and the division are "presence". In order of the special control D, the special control C, the special control B, the special control A, and the normal control, the ink supply is less likely to be delayed, that is, the delay in the supply of ink can be further suppressed.

A-5. Control for Shifting Discharge Position

Figure 9A:
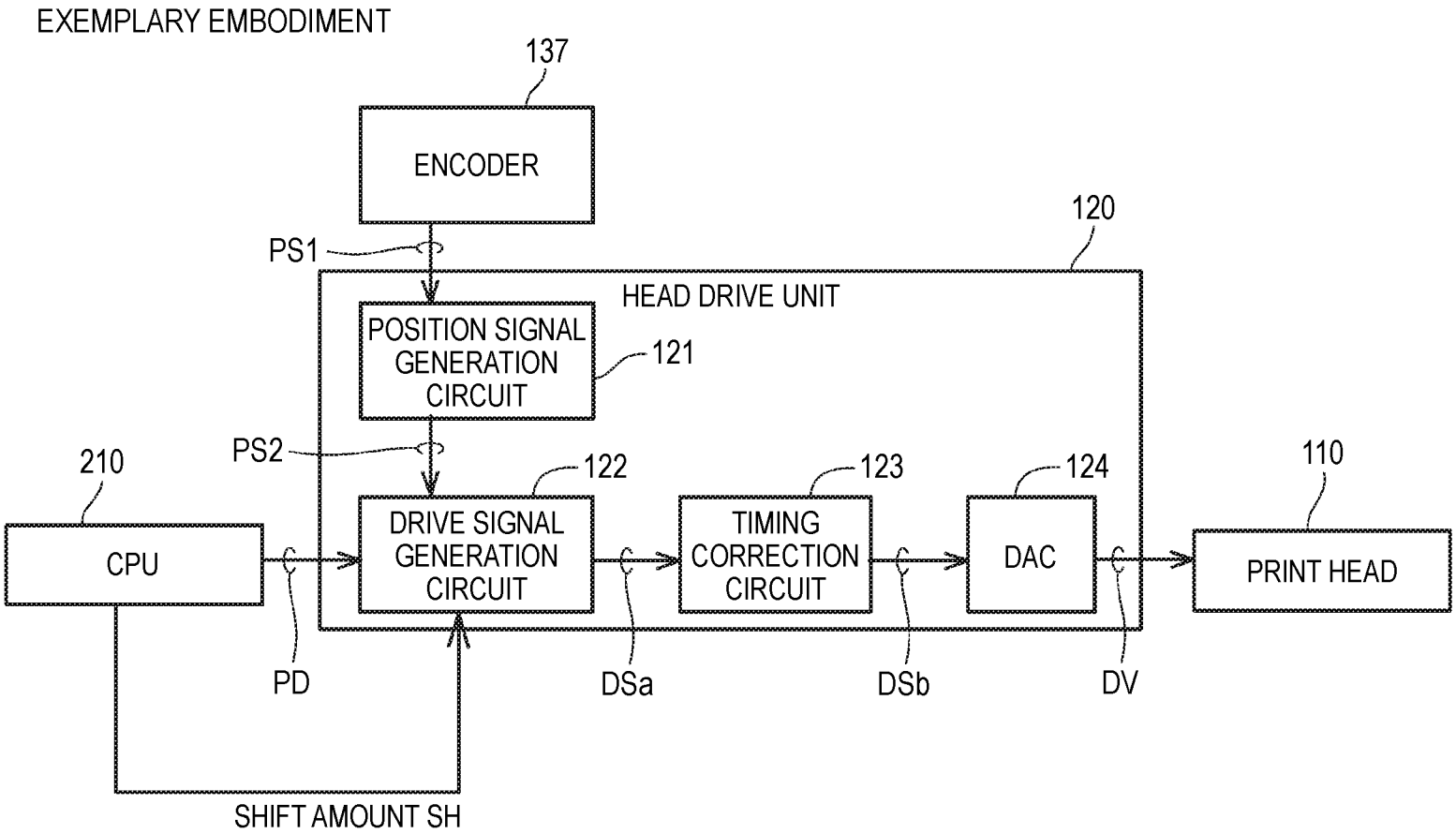
FIGS. 9A and 9B are block diagrams illustrating configurations of a head drive unit.
Figure 9B:
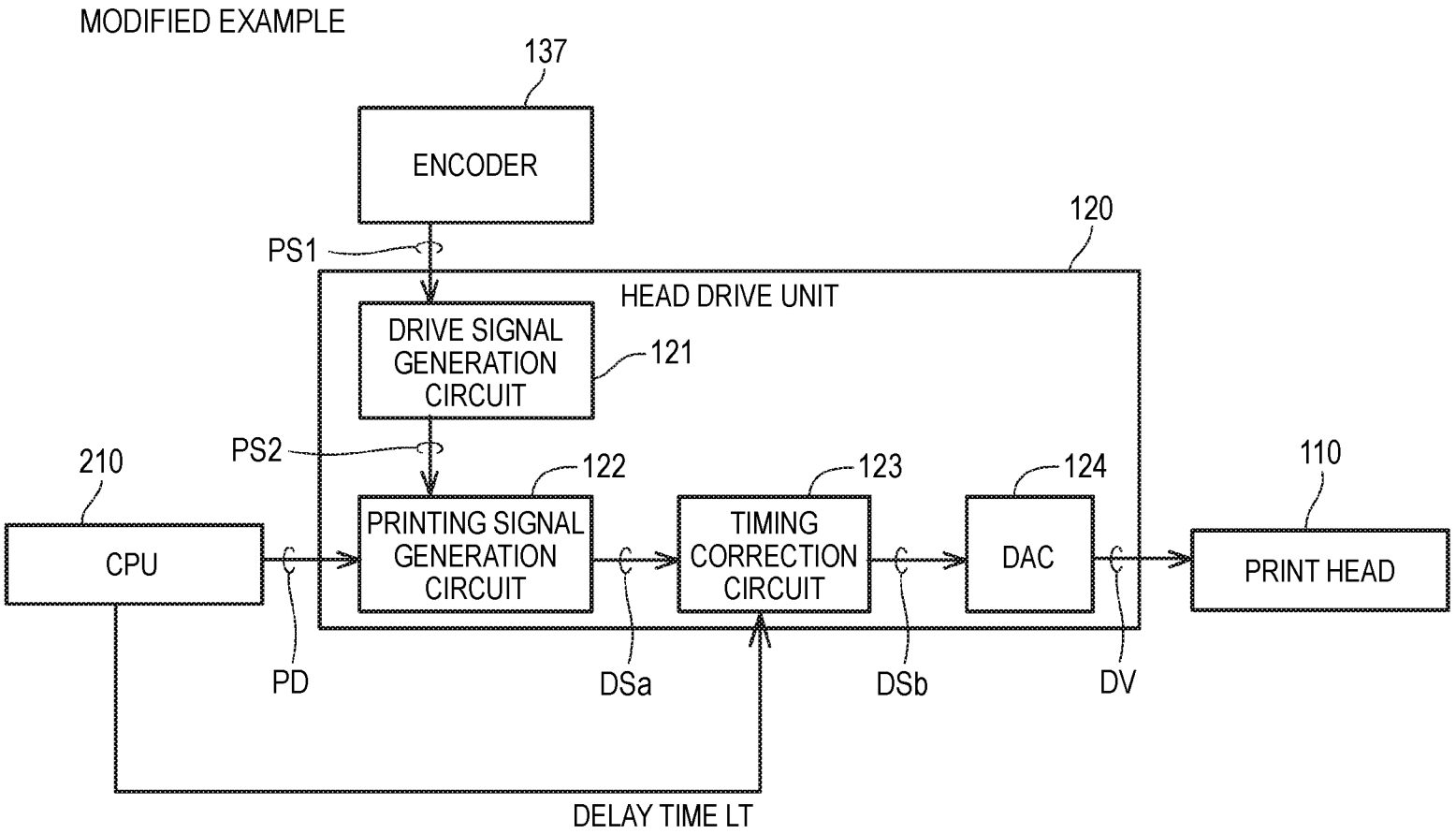

Next, control for shifting the discharge position performed in the special controls A to C described above will be described. FIGS. 9A and 9B are block diagrams illustrating the configuration of the head drive unit 120. The head drive unit 120 includes a position signal generation circuit 121, a drive signal generation circuit 122, a timing correction circuit 123, and a DA converter 124. The position signal generation circuit 121, the drive signal generation circuit 122, and the timing correction circuit 123 are configured using, for example, a hardware circuit such as an ASIC.

The position signal generation circuit 121 generates a position signal PS2 indicating the position in the main-scanning direction of the print head 110 with higher resolution than that of a position signal PS1, based on the position signal PS1 supplied from the encoder 160. The position signal generation circuit 121 generates the position signal PS2 by dividing a pulse interval of the position signal PS1 into a plurality of signals.

The drive signal generation circuit 122 generates a drive signal DSa including drive pulses for driving respective actuators of the nozzles NZ of the print head 110, based on partial image data PD supplied from the CPU 210. The drive signal generation circuit 122 can recognize the position of the print head 110 in the main-scanning direction based on the position signal PS2 supplied from the position signal generation circuit 121. The drive signal generation circuit 122 generates a drive pulse in accordance with the timing at which the print head 110 during the main-scanning reaches the discharge position where ink is to be discharged, thereby generating the drive signal Dsa.

The timing correction circuit 123 is a circuit that delays the drive pulse included in the drive signal DSa by a correction amount supplied for each pulse, using a clock signal (not illustrated). A drive signal DSb after correction is output from the timing correction circuit 123. The timing correction circuit 123 is used, for example, to finely adjust the timing of discharging the ink according to the distance between the print head 110 and the paper M. The correction amount is instructed from, for example, the CPU 210. In this exemplary embodiment, the timing correction circuit 123 is not used to shift the discharge position.

The DA converter 124 is a circuit for converting the corrected drive signal DSb into a drive voltage DV to be supplied to the actuator for driving the nozzle NZ. The drive voltage DV output from the DA converter 124 is supplied to the print head 110. As a result, the actuator in the print head 110 is driven to discharge the ink from the nozzle NZ.

In this example, as illustrated in FIG. 9A, the CPU 210 supplies the shift amount SH to the drive signal generation circuit 122. When the shift amount SH to be supplied is "0", the drive signal generation circuit 122 generates the drive signal DSa so as to start the multiple times of discharge of ink in single partial printing when the print head 110 is at a predetermined reference position. When the shift amount SH to be supplied is "small" or "large", the drive signal generation circuit 122 generates the drive signal DSa so as to start the multiple times of discharge of ink in single partial printing when the print head 110 is positioned on the downstream side of the main-scanning, which is shifted by the shift amount SH of "small" or "large", with respect to the predetermined reference position. The position of the print head 110 is determined based on the position signal PS2, as described above. With this configuration, the CPU 210 can realize shifting of the discharge position based on the position signal PS1 from the encoder 160. Accordingly, in the normal control and the special controls A to D, ink can be discharged at an appropriate position of the print head 110. In this exemplary embodiment, since the timing correction circuit 123 is not used, the corrected drive signal DSb is the same signal as the drive signal DSa.

In the modified example, as illustrated in FIG. 9B, the CPU 210 supplies delay time LT corresponding to the shift amount SH to the timing correction circuit 123. The drive signal generation circuit 122 starts the multiple times of discharge of ink in single partial printing when the print head 110 is at the predetermined reference position, regardless of the shift amount SH. The timing correction circuit 123 delays each drive pulse included in the drive signal DSa by the delay time LT corresponding to the shift amount SH.

Accordingly, in the modified example, when the shift amount SH is "0", the timing correction circuit 123 does not delay each drive pulse included in the drive signal DSa. Accordingly, the corrected drive signal DSb output from the timing correction circuit 123 is the same as the drive signal DSa. For this purpose, in this case, ink is discharged when the print head 110 is at the discharge position (that is, the discharge position according to the drive signal Dsa) determined based on the position signal PS1 from the encoder 160.

In the modified example, when the shift amount SH is "small" or "large", the timing correction circuit 123 delays each drive pulse included in the drive signal DSa by the delay time LT corresponding to the shift amount SH of "small" or "large". Accordingly, the corrected drive signal DSb output from the timing correction circuit 123 is delayed more than the drive signal DSa. For this purpose, in this case, the ink is discharged after the predetermined delay time LT from when the print head 110 is at the discharge position determined based on the output signal from the encoder 160. With this configuration, the CPU 210 can discharge the ink at an appropriate position of the print head 110 using the delay time LT.

According to this exemplary embodiment described above, when the first condition which is determined for every partial printing and indicates that the supply of ink may be delayed is satisfied, the special control A is executed. The first condition corresponds to, for example, a case where the cumulative ink use amount TA is "small", the head temperature Th is "low", and the determination threshold value JT is 70% to 80% (FIGS. 7A and 7B). Furthermore, when the first condition is not satisfied, for example, when the cumulative ink use amount TA is "small", the head temperature Th is "low", and the determination threshold value JT is less than 70%, the normal control is executed.

In the normal control, in partial printing, the main-scanning is performed at the main-scanning speed SS of "high", and when the print head 110 is at the first discharge position X1 in the direction of main-scanning (see FIG. 8A), the ink I1 is discharged. In the special control A, the main-scanning is performed at the main-scanning speed SS of "medium" slower than "high", and when the print head 110 is at a second discharge position (X1+SH) on the downstream side of the first discharge position X1 in the main-scanning, the ink I1 is discharged (FIG. 8B).

With this configuration, in the special control A, since the main-scanning is performed at the main-scanning speed SS of "medium" slower than "high", it is possible to suppress the delay in the supply of ink. Furthermore, in the special control A, when the print head 110 is at the second discharge position (X1+SHs) on the downstream side of the first discharge position X1 in the main-scanning, the ink I1 is discharged. As a result, it is possible to suppress deviation of the dot formation position in the print image OI due to the reduction in the main-scanning speed SS. Accordingly, it is possible to suppress degradation in image quality in order to suppress the delay in the supply of ink, while suppressing the delay in the supply of ink.

Furthermore, according to this exemplary embodiment, when the second condition, which is determined for every partial printing and indicates that the supply of ink to the print head 110 is likely to be delayed compared to the case where the first condition is satisfied, is satisfied, the control B is executed. The second condition corresponds to, for example, the case where the cumulative ink use amount TA is "small", the head temperature Th is "low", and the determination threshold value JT is 80% to 90% (FIGS. 7A and 7B).

In the special control B, in partial printing, the main-scanning is performed at the main-scanning speed SS of "low" which is slower than "medium", and when the print head 110 is at a third discharge position (X1+SHb) on the downstream side of the second discharge position (X1+SHs) in the main-scanning, the ink I1 is discharged (FIG. 8D).

With this configuration, in the special control B, the main-scanning is performed at the main-scanning speed SS of "low" slower than the "medium" and thus, the delay in the supply of ink can be further suppressed. Furthermore, in the special control B, when the print head 110 is at the third discharge position (X1+SHb) on the downstream side of the second discharge position (X1+SHs) in the main-scanning, the ink I1 is discharged and thus, it is possible to suppress deviation of the dot formation position in the print image OI due to the main-scanning speed SS being further reduced. Accordingly, it is possible to suppress degradation in image quality in order to suppress the delay in the supply of ink while further suppressing the delay in the supply of ink.

Furthermore, according to this exemplary embodiment, when a third condition, which is determined for every partial printing and indicates that the supply of ink to the print head 110 is likely to be delayed as compared to a case where the first condition or the second condition is satisfied, is satisfied, the special control C is executed. The third condition corresponds to, for example, the case where the cumulative ink use amount TA is "small", the head temperature Th is "low", and the determination threshold value JT is 90% to 95% (FIGS. 7A and 7B). In the special control C, after waiting for a predetermined wait time after the last partial printing, the main-scanning is performed at the main-scanning speed SS of "medium" to execute the partial printing of interest. As a result, the delay in the supply of ink can be further suppressed.

Furthermore, according to this exemplary embodiment, when a fourth condition, which is determined for every partial printing and indicates that the supply of ink to the print head 110 is likely to be delayed as compared to the case where the first to third conditions are satisfied, is satisfied, the special control D is executed. The fourth condition corresponds to, for example, the case where the cumulative ink use amount TA is "small", the head temperature Th is "low", and the determination threshold value JT exceeds 95% (FIGS. 7A and 7B). In the special control D, a partial image of interest to be printed in single partial printing is printed by being divided into two partial printings. As a result, the delay in the supply of ink can be further suppressed.

Furthermore, according to this exemplary embodiment, whether or not the first to fourth conditions are satisfied is determined using the cumulative ink use amount TA and the dot formation rate DR. As a result, it is possible to appropriately determine whether or not the supply of ink may be delayed or delayability in the supply of ink.

Specifically, as described above, the delay in the supply of ink is more likely to occur as the cumulative ink use amount TA becomes larger. Furthermore, since the pass ink use amount PA becomes larger as the dot formation rate DR becomes larger, a delay in the supply of a specific ink is likely to occur. Taking this into consideration, in the threshold value table TT, the determination threshold value JT set for the dot formation rate DR is set to be smaller as the cumulative ink use amount TA becomes larger (FIG. 7A). The control selection table ST is set such that control with which the supply of ink is less likely to be delayed (control with which the delay in the supply of ink can be further suppressed) is selected as the dot formation rate DR becomes higher (FIG. 7B). As a result, it is possible to appropriately determine whether or not the supply of ink may be delayed or delayability in the supply of ink, using the cumulative ink use amount TA and the dot formation rate DR.

Furthermore, the delay in the supply of ink is more likely to occur as the head temperature Th becomes lower. In this exemplary embodiment, whether or not the first to fourth conditions are satisfied is determined using the head temperature Th (FIGS. 7A and 7B). For example, in the threshold value table TT, the determination threshold value JT set for the dot formation rate DR is set to be smaller as the head temperature Th becomes lower (FIG. 7A). As a result, it is possible to appropriately determine whether or not the supply of ink may be delayed or delayability in the supply of ink, using the head temperature Th.

In the example of the table ST1 of FIG. 7B, when the dot formation rate DR is a first value (for example, 75%) larger than the determination threshold value JT (70%), the special control A in which the main-scanning speed SS of "medium" is adopted is selected. Then, when the dot formation rate DR is a second value (for example, 85%) larger than the first value, the special control B in which the main-scanning speed SS of "low" is adopted is selected. That is, according to this exemplary embodiment, when the dot formation rate DR is the first value, the main-scanning is performed at the main-scanning speed SS of "medium" slower than the main-scanning speed SS of "high" by the first amount and when the dot formation rate DR is a second value larger than the first value, the main-scanning is performed at the main-scanning speed SS of "low" slower than the main-scanning speed SS of "high" by the second amount (however, the second amount is greater than the first amount). As a result, since the main-scanning is performed at an appropriate speed according to the size of the dot formation rate DR, the delay in the supply of ink can be more effectively suppressed.

As understood from the above description, the whole of the CPU 210 and the head drive unit 120 in this exemplary embodiment is an example of a controller.

Figures 10A, 10B:
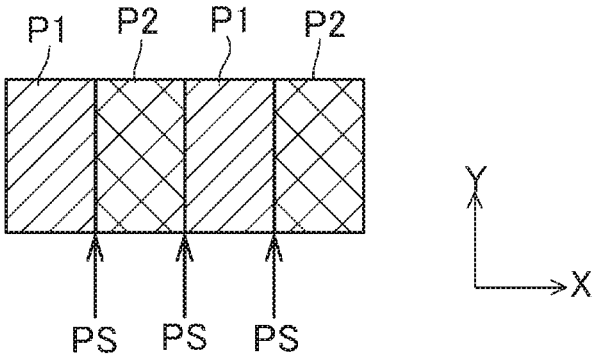
FIGS. 10A and 10B are explanatory diagrams of determination of a shift amount of a modification exemplary embodiment.

B. Modified Example (1) In the exemplary embodiment described above, the shift amount SH is determined with reference to the control condition table CT of FIG. 7C. The method of determining the shift amount SH is not limited thereto. FIGS. 10A and 10B are explanatory diagrams of the determination of the shift amount SH according to the modified example.

In the printing process of this modified example, any of unidirectional printing or bidirectional printing is performed based on a user's instruction. In the unidirectional printing, only one of the forward printing and the backward printing is performed. In the bidirectional printing, the forward printing and the backward printing are alternately performed as described in the exemplary embodiment. In the printing process of this modified example, the main-scanning speed SS is determined, for example, with reference to the control condition table CT of FIG. 7C. Then, in the printing process of this exemplary embodiment, the shift amount SH is determined with reference to a shift amount setting table SFT of FIG. 10A.

In the shift amount setting table SFT, the corresponding shift amount SH is recorded for a combination of the main-scanning speed SS of the last partial printing, the main-scanning speed SS of the partial printing of interest, and a printing type (unidirectional printing or bidirectional printing). For example, when the main-scanning speed SS of the last partial printing is "high", the main-scanning speed SS of the partial printing of interest is "medium", and the printing type is unidirectional printing, the shift amount SH of the partial printing of interest is determined to be "SHA". When the main-scanning speed SS of the last partial printing is "high", the main-scanning speed SS of the partial printing of interest is "low", and the printing type is bidirectional printing, the shift amount SH of the partial printing of interest is determined to be "SHD". The shift amounts SHA to SHF recorded in the shift amount setting table SFT may be different from one another.

The shift amounts SHA to SHF are determined, for example, by printing a test image TI illustrated in FIG. 10B using the printer 200 and visually evaluating the printed test image TI. The test image TI includes a first portion P1 represented by hatching and a second portion P2 represented by cross hatching. On image data, the first portion P1 and the second portion P2 are images having the same color, and there is no gap or overlap in a boundary PS between the first portion P1 and the second portion P2. That is, the test image TI is one rectangle having uniform color on the image data.

For example, the shift amount SHA recorded in the shift amount setting table SFT is determined as follows. The printer 200 prints a plurality of test images TI by printing the first portion P1 in the forward printing at the main-scanning speed SS of "high" and printing the second portion P2 in the forward printing at the main-scanning speed SS of "medium". In this case, the shift amount of forward printing at the main-scanning speed SS of "high" is set to "0", and the shift amount of forward printing at the main-scanning speed SS of "medium" is set to a different candidate amount for each of the plurality of test images TI. If the shift amount is appropriate, no gap or overlap appears at the boundary PS between the first portion P1 and the second portion P2 in the test image TI. If the shift amount is inappropriate, a gap or overlap appears at the boundary PS between the first portion P1 and the second portion P2 in the test image TI. For this purpose, a tester visually checks the plurality of test images TI and specifies one test image TI in which no gap or overlap appears at the boundary PS. A shift amount corresponding to the specified test image TI is recorded as the shift amount SHA in the shift amount setting table SFT.

When the shift amount SHB recorded in the shift amount setting table SFT is determined, the plurality of test images TI are printed by printing the first portion P1 in the forward printing at the main-scanning speed SS of "high" and printing the second portion P2 in the backward printing at the main-scanning speed SS of "medium". Then, the shift amount SHB is determined by the same evaluation method as in determining the shift amount SHA. Other shift amounts SHC to SHF are similarly determined.

For example, during the main-scanning, due to various physical factors such as load applied to the print head 110 by the tube 152 of the ink supply unit 150, the speed may slightly differ between the main-scanning in the forward direction and the main-scanning in the backward direction. As a result, an appropriate shift amount SH to suppress deviation of the dot formation position may be different depending on the combination of the main-scanning speed SS and main-scanning direction of the last partial printing and the main-scanning speed SS and main-scanning direction of the partial printing of interest. According to this modified example, since a different shift amount can be set for each combination, it is possible to more effectively suppress degradation in image quality of the print image due to the deviation of the dot formation position.

As understood from the above description, in this modified example, when the main-scanning direction of the partial printing of interest is the same as the main-scanning direction of the last partial printing (for example, in the case of unidirectional printing), the CPU 210 sets the shift amount SH to the first shift amount (for example, SHA, SHC, or SHE in FIG. 10A), and when the main-scanning direction of the partial printing of interest is opposite to the main-scanning direction of the last partial printing (for example, in the case of bidirectional printing), the CPU 210 sets the shift amount SH to a second shift amount (for example, SHB, SHD, or SHF in FIG. 10B) different from the first shift amount. As a result, an appropriate shift amount can be used when the main-scanning direction of the partial printing of interest is the same as or opposite to the direction of the main-scanning of the last partial printing. As a result, it is possible to more appropriately suppress the deviation of the dot positions formed by ink in an image to be printed due to the reduction in the main-scanning speed.

(2) In the exemplary embodiment described above, four types of special controls A to D are adopted, but is not limited thereto. For example, only the special control A may be adopted. In this case, for example, when it is determined, in S250 of FIG. 5, that the dot formation rate DR is greater than the determination threshold value JT for at least one ink (YES in S250), the special control A is determined as execution control in S270. Then, when it is determined that the dot formation rate DR is equal to or less than the determination threshold value JT (NO in S250), the normal control is determined as execution control in S260.

Any two or three of the four special controls A to D may be adopted. For example, only two types of special controls A and B may be adopted, or only two types of special controls A and C may be adopted.

(3) In the exemplary embodiment described above, the condition indicating whether or not a delay in the supply of ink may occur is determined using the head temperature Th, the cumulative ink use amount TA, and the dot formation rate DR, but is not limited thereto. For example, the condition may be determined using only the head temperature Th and the dot formation rate DR. In this case, for example, only the three determination threshold values JT corresponding to three types of head temperature Th (low, medium, and high) may be defined in the threshold table TT of FIG. 7A. The condition may be determined using only the cumulative ink use amount TA and the dot formation rate DR. In this case, only the three determination threshold values JT corresponding to three types of cumulative ink use amount TA (small, medium, and large) may be defined in the threshold value table TT.

Instead of the dot formation rate DR, another index value regarding the pass ink use amount PA may be adopted. For example, the other index value may be the total number of dots of each ink formed when printing the partial image of interest. Instead of the cumulative ink use amount TA, another index value related to the cumulative ink use amount may be adopted. For example, another index value may be the cumulative number of printed sheets. Since it can be said that the cumulative ink use amount TA becomes larger as the cumulative number of printed sheets becomes larger, it can be said that the cumulative number of printed sheets is an index value regarding the cumulative ink use amount TA.

(4) In the print mechanism 100 according to the exemplary embodiment described above, the conveyance unit 140 conveys the paper M, so that sub-scanning for moving the paper M relative to the print head 110 in the conveyance direction is performed. Alternatively, the sub-scanning may be performed by moving the print head 110 in the direction opposite to the conveyance direction with respect to the fixed paper M.

(5) As the printing medium, instead of the paper M, another medium, for example, a film for OHP, a CD-ROM, or a DVD-ROM may be adopted.

(6) In each exemplary embodiment described above, a device that executes the printing process of FIG. 5 is the CPU 210 of the printer 200. Alternatively, the printing process of FIG. 5 may be executed by another type of device, for example, the terminal device 300. In this case, for example, the terminal device 300 operates as a printer driver by executing a driver program, and controls the printer 200 as a printing execution unit as a part of the function as the printer driver, thereby controlling the printing process of FIGS. 7A, 7B, and 7C to be executed. In this case, the terminal device 300 realizes conveyance of the paper M in S105 and S115 of FIG. 5 by transmitting a conveyance command including information indicating a conveyance amount of the paper M to the printer 200. The terminal device 300 realizes acquisition of partial image data in S110 of FIG. 5, for example, by executing processing including color conversion processing and halftone processing on image data such as RGB image data and generating dot data. The terminal device 300 realizes partial printing in S125 of FIG. 5, for example, by transmitting a partial printing command including partial image data, information indicating the main-scanning speed SS, and the shift amount SH to the printer 200.

As understood from the above description, in the exemplary embodiment described above, the print mechanism 100 is an example of the printing execution unit. When the terminal device 300 executes the printing process as in this modified example, the entire printer 200 that executes printing is an example of the printing execution unit.

(7) The device that executes the printing process of FIG. 5 may be a server that acquires image data from the printer 200 or the terminal device 300, generates the conveyance command or partial printing command described above using the image data, and transmits these commands to the printer 200. Such a server may be a plurality of computers that can communicate with each other via a network.

(8) In each exemplary embodiment described above, a part of the configuration realized by hardware may be replaced by software and conversely, a part or the whole of the configuration realized by software may be replaced by hardware. For example, a part of the printing process of FIG. 5 may be realized by a dedicated hardware circuit (for example, an ASIC) that operates according to an instruction of the CPU 210.

Although the present disclosure has been described above based on the exemplary embodiments and modified example, the embodiment of the invention described above is for the purpose of facilitating the understanding of the present disclosure, and does not limit the present disclosure. The present disclosure may be modified and improved without departing from the spirit and the scope of the claims, and the present disclosure includes the equivalents thereof.

What is claimed is:

1. A printing device comprising:

a print head that includes a plurality of nozzles to discharge ink;

an ink supply unit configured to supply the ink to the print head;

a main-scanning unit configured to perform main-scanning in which the print head is moved with respect to a print medium;

a sub-scanning unit configured to perform sub-scanning in which the print medium is moved along a direction intersecting a direction of the main-scanning with respect to the print head; and a controller configured to perform printing, in which partial printing that causes the print head to discharge the ink while controlling the main-scanning unit to perform the main-scanning and the sub-scanning by the sub-scanning unit are executed multiple times, wherein a first condition indicates that the supply of the ink from the ink supply unit to the print head in the partial printing is likely to be delayed, a satisfaction of the first condition is determined by the partial printing basis, in a first case where a first condition is not satisfied, in the partial printing, the controller controls the main-scanning unit to perform the main-scanning at a first speed and controls the print head to discharge the ink to correspond to a specific pixel of a partial image to be printed by the partial printing when the print head is at a first position in the direction of the main-scanning, and in a second case where the first condition is satisfied, in the partial printing, the controller controls the main-scanning unit to perform the main-scanning at a second speed slower than the first speed and controls the print head to discharge the ink to correspond to the specific pixel when the print head is at a second position, which is located at a downstream of the first position in the direction of the main-scanning.

2. The printing device according to claim 1, further comprising:

an encoder configured to detect a position of the print head in the direction of the main-scanning, wherein in the first case, the controller controls the print head to start multiple ink discharging in a single partial printing when the print head is at a reference position, based on an output signal from the encoder so that the ink is discharged to correspond to the specific pixel when the print head is at the first position, and in the second case, the controller controls the print head to start the multiple ink discharging in the single partial printing when the print head is at a position shifted to a downstream side of the reference position in the main-scanning, based on an output signal from the encoder so that the ink is discharged to correspond to the specific pixel when the print head is at the second position.

3. The printing device according to claim 1, further comprising:

an encoder configured to detect a position of the print head in the direction of the main-scanning, wherein in the first case, the controller controls the print head to discharge the ink to correspond to the specific pixel when the print head is at the first position that is determined based on an output signal from the encoder, and in the second case, the controller controls the print head to discharge the ink to correspond to the specific pixel after a predetermined delay time from a time when the print head is at the first position that is determined based on the output signal from the encoder, so that the ink is discharged to correspond to the specific pixel when the print head is at the second position.

4. The printing device according to claim 1, wherein a second condition indicates that the supply of the ink to the print head is likely to be delayed as compared to a case where the first condition is satisfied, a satisfaction of the second condition is determined by the partial printing basis, and in a case where the second condition is satisfied, the controller controls the main-scanning unit to perform the main-scanning at a third speed slower than the second speed and controls the print head to discharge the ink to correspond to the specific pixel when the print head is at a third position, which is located at a downstream side of the second position in the direction of the main-scanning.

5. The printing device according to claim 1, wherein a third condition indicates that the supply of the ink to the print head is likely to be delayed as compared to the case where the first condition is satisfied, a satisfaction of the third condition is determined by the partial printing basis, and in a case where the third condition is satisfied, the controller controls the main-scanning unit to perform the main-scanning at the second speed after waiting for a predetermined time after the last partial printing.

6. The printing device according to claim 1, wherein a fourth condition indicates that the supply of the ink to the print head is likely to be delayed compared to the case where the first condition is satisfied, a satisfaction of the fourth condition is determined by the partial printing basis, and in a case where a fourth condition is satisfied, the controller divides the partial image to be printed in the partial printing to be printed in multiple partial printings.

7. The printing device according to claim 1, wherein the first condition is determined based on an index value, and the index value is one of a value relating to a use amount of the ink, which is calculated based on partial image data corresponding to the partial image to be printed by the partial printing and is used for printing the partial image, and a value relating to a cumulative use amount of the ink used for printing in the printing device.

8. The printing device according to claim 7, wherein the first condition is that the index value is larger than a threshold value, in a case where the index value is a first value larger than the threshold value, the controller controls the main-scanning unit to perform the main-scanning at a speed slower than the first speed by a first amount, as the second speed, in a case where the index value is a second value larger than the first value, the controller controls the main-scanning unit to perform the main-scanning at a speed slower than the first speed by a second amount, as the second speed, and the second amount is greater than the first amount.

9. The printing device according to claim 1, wherein in the second case, when the direction of the main-scanning in the partial printing to be executed is the same as the direction of the main-scanning in the last partial printing, the controller controls the print head to discharge the ink to correspond to the specific pixel at a position where a shift amount from the first position is a first shift amount, as the second position, and in the second case, when the direction of the main-scanning of the partial printing to be executed is opposite to the direction of the main-scanning of the last partial printing, the controller controls the print head to discharge the ink to correspond to the specific pixel at a position where the shift amount is a second shift amount different from the first shift amount as the second position.

10. A control method of a printing execution unit including: a print head that includes a plurality of nozzles to discharge ink; an ink supply unit that supplies the ink to the print head; a main-scanning unit that performs main-scanning in which the print head is moved with respect to a print medium; and a sub-scanning unit that performs sub-scanning in which the print medium is moved along a direction intersecting a direction of the main-scanning with respect to the print head, and performs printing, in which partial printing that causes the print head to discharge the ink while controlling the main-scanning unit to perform the main-scanning and the sub-scanning by the sub-scanning unit are executed multiple times, the method comprising:

controlling, in a first case where a first condition is not satisfied, in the partial printing, the main-scanning unit to perform the main-scanning at a first speed and controls the print head to discharge the ink to correspond to a specific pixel of a partial image to be printed by the partial printing when the print head is at a first position in the direction of the main-scanning; and controlling, in a second case where the first condition is satisfied, in the partial printing, the main-scanning unit to perform the main-scanning at a second speed slower than the first speed and controls the print head to discharge the ink to correspond to the specific pixel when the print head is at a second position, which is located at a downstream of the first position in the direction of the main-scanning, wherein a first condition indicates that the supply of the ink from the ink supply unit to the print head in the partial printing is likely to be delayed, and a satisfaction of the first condition is determined by the partial printing basis.

11. A non-transitory computer-readable medium having instructions to control a computer of a printing device including: a print head that includes a plurality of nozzles to discharge ink; an ink supply unit configured to supply the ink to the print head; a main-scanning unit configured to perform main-scanning in which the print head is moved with respect to a print medium; and a sub-scanning unit configured to perform sub-scanning in which the print medium is moved along a direction intersecting a direction of the main-scanning with respect to the print head, and performing printing, in which partial printing that causes the print head to discharge the ink while controlling the main-scanning unit to perform the main-scanning and the sub-scanning by the sub-scanning unit are executed multiple times, the instructions that, when executed by the computer, cause the printing device to perform operations comprising:

controlling, in a first case where a first condition is not satisfied, in the partial printing, the main-scanning unit to perform the main-scanning at a first speed and controls the print head to discharge the ink to correspond to a specific pixel of a partial image to be printed by the partial printing when the print head is at a first position in the direction of the main-scanning; and controlling, in a second case where the first condition is satisfied, in the partial printing, the main-scanning unit to perform the main-scanning at a second speed slower than the first speed and controls the print head to discharge the ink to correspond to the specific pixel when the print head is at a second position, which is located at a downstream of the first position in the direction of the main-scanning, wherein a first condition indicates that the supply of the ink from the ink supply unit to the print head in the partial printing is likely to be delayed, and a satisfaction of the first condition is determined by the partial printing basis.

* * * * *